US008459192B2

(12) United States Patent
Ahola

(10) Patent No.: US 8,459,192 B2
(45) Date of Patent: Jun. 11, 2013

(54) DEVICE FOR GASIFICATION AND COMBUSTION OF SOLID FUEL

(76) Inventor: Kimmo Ahola, Koivisto (FI)

( * ) Notice: Subject to any disclaimer, the term of this patent is extended or adjusted under 35 U.S.C. 154(b) by 1015 days.

(21) Appl. No.: 12/456,866

(22) Filed: Jun. 24, 2009

(65) Prior Publication Data

US 2010/0326338 A1 Dec. 30, 2010

(51) Int. Cl.
*F23G 5/027* (2006.01)
*F23G 7/00* (2006.01)
*F23D 14/20* (2006.01)

(52) U.S. Cl.
USPC ..... 110/229; 110/235; 110/295

(58) Field of Classification Search
USPC ..... 110/229, 230, 210, 211, 214, 344, 110/118, 207, 251, 252, 182.5, 295, 302, 110/303, 346, 347; 126/68, 73, 76, 77, 99 R, 126/107, 112, 146, 152 R, 163 R, 163, 283, 126/501
See application file for complete search history.

(56) References Cited

U.S. PATENT DOCUMENTS

| | | | | | |
|---|---|---|---|---|---|
| 2,354,963 | A | | 8/1944 | Ohlsson | |
| 4,463,687 | A | * | 8/1984 | Zimmerman et al. | 110/233 |
| 4,630,553 | A | * | 12/1986 | Goetzman | 110/214 |
| 4,782,765 | A | * | 11/1988 | Miller et al. | 110/186 |
| 4,832,000 | A | * | 5/1989 | Lamppa et al. | 126/77 |
| 4,987,115 | A | * | 1/1991 | Michel-Kim | 502/419 |
| 5,054,405 | A | * | 10/1991 | Walker | 110/254 |
| 5,178,076 | A | * | 1/1993 | Hand et al. | 110/210 |
| 5,284,103 | A | * | 2/1994 | Hand et al. | 110/255 |
| 5,471,937 | A | * | 12/1995 | Kosky et al. | 110/345 |
| 6,336,449 | B1 | | 1/2002 | Drisdelle et al. | |
| 6,401,636 | B2 | * | 6/2002 | Brunnmair et al. | 110/346 |
| 6,807,915 | B2 | * | 10/2004 | Sugano et al. | 110/233 |
| 7,261,046 | B1 | * | 8/2007 | Rettig et al. | 110/345 |
| 7,571,687 | B2 | * | 8/2009 | Cornellier | 110/229 |
| 2008/0072805 | A1 | * | 3/2008 | Cole et al. | 110/229 |
| 2008/0127867 | A1 | * | 6/2008 | Cole et al. | 110/230 |

FOREIGN PATENT DOCUMENTS

| | | |
|---|---|---|
| CH | 654 899 | 3/1986 |

* cited by examiner

*Primary Examiner* — Kenneth Rinehart
*Assistant Examiner* — David J Laux
(74) *Attorney, Agent, or Firm* — F. Brice Faller

(57) ABSTRACT

A partition divides an enclosure into an upper space and a lower space, the partition having a hole which provides essentially the only passage for gas to flow from the lower space to the upper space. A reactor tube having open ends is supported by the partition over the hole, and a grate spaced below the hole. A primary air inlet arrangement feeds air into the lower space for gasification of solid fuel on the grate, and a secondary air inlet directs a jet of air toward the inlet end of combustion tube communicating with the upper space and having an open exhaust end outside the enclosure. Product gas formed by gasification of solid fuel on the grate and passing through the reactor tube into the upper space will be drawn into the combustion tube to create a sub-atmospheric pressure in the upper space.

20 Claims, 5 Drawing Sheets

DEVICE FOR GASIFICATION AND COMBUSTION OF SOLID FUEL

FIELD OF THE INVENTION

The invention relates to a combustion device for gasification and combustion of solid fuel, in particular to a pellet burner, of the type having a grate which receives the solid fuel, a primary air inlet arrangement which provides air to the grate for gasification of the solid fuel to form product gas, and a secondary air inlet arrangement for blowing a stream of air into a combustion tube in order to draw product gas into the combustion tube and lower the pressure in the reactor space.

DESCRIPTION OF THE RELATED ART

A typical pellet heating system includes a boiler with water circulation, a pellet burner, and a system for storing and transferring pellets. The boiler can be designed for an oil burner or can be intended particularly for combustion of solid fuel, such as a multi-fuel boiler or a boiler designed particularly for burning of pellets. The known pellet burners can be divided into three different main types depending on the feed inlet of pellets: under-feed burners, horizontal feed burners and overfeed burners. In under-feed burners the pellets are fed to the combustion chamber from below, in which case they are forced through the whole combustion zone. In horizontal feed burners the pellets are fed to the combustion space from the side, and in overfeed burners the pellets are dropped into the combustion space from above. Due to the different manners of feeding fuel, the different types of burners also deviate from each other for their ash removal and air feed implementations. Operating of a pellet burner is controlled by means of a control system, which controls, e.g., feeding of fuel and air automatically as needed. Pellets can also be combusted in continuously operating so-called Stoker-burners either separately or mixed with chips. The burner can be also implemented in a built-in manner with the boiler.

Several problems arise with pellet burners presently in use, and with the combustion of pellets. First of all, pellets are typically burned on a grate or a platform, which reaches inside the combustion chamber of the boiler. Further, combustion takes place at relatively low temperatures. Ash remains in place and easily gets mixed with new pellets added into the combustion space, thus disturbing the combustion process. Due to incomplete combustion and low combustion temperature, a large amount of flue gas develops and the burner efficiency remains low. Additionally, the amount of residual oxygen in the flue gas exhausted from the burner is very high. Also, ash and fine particles drift along with the flue gas away from the burner, which is why the burner's particulate emissions increase and a need for chimney sweeping of the smoke flue arises. In many kinds of burners, the ash remains inside the boiler, where it must be removed manually. Removal of ash is particularly laborious, when the pellet burner is mounted in an old oil boiler, where removal of ash was not originally considered.

U.S. Pat. No. 6,336,449 and CH 654 899 present solutions applicable particularly to vacuum-operated combustion or gasification of particle-like solid fuels, such as pellets, wherein solid fuel is gasified in a reactor on a grate by feeding gasification air in connection therewith by means of a primary air inlet arrangement, and product gas produced as a result of the gasification is fed in the combustion device into a tube-like combustion channel into which secondary air is fed for combustion of the product gas.

U.S. Pat. No. 2,354,963 discloses a combustion device and method for gasification and combustion of solid fuel, typically wood chips, wherein the combustion device has a reactor space, a reactor provided with a grate for gasification of the solid fuel, a primary air inlet arrangement for feeding of gasification air in connection with the grate, and a secondary air inlet arrangement including a nozzle for blowing a jet of air into a venturi-shaped combustion channel, in order to burn the product gas generated during gasification. A partial vacuum is produced in the reactor space by the jet of air, which sucks along product gas from the reactor space to cause a so-called ejector action according to Bemoulli's principle. Note that this device would not be suitable for burning pellets, because of the high temperatures in the feed column, which would cause pellets to disintegrate long before they reach the grate.

None of the devices described above significantly decreases the problems related to gasification of solid fuel, particularly with regard to feeding of secondary air into the product gas and/or the structural solutions of the reactor space, because a mixing of combustion air and product gas that is sufficient to ensure complete combustion and optimum efficiency cannot be achieved.

SUMMARY OF THE INVENTION

According to the invention, an enclosure is separated into an upper space and a lower space by a partition having a hole which provides essentially the only passage for flow of gas from the lower space to the upper space. A reactor tube having an open upper end in the upper space and an open lower end is supported by the partition over the hole, and a grate is located in the lower space below the hole. A primary air inlet is arranged to feed air into the lower space for gasification of solid fuel on the grate. A combustion tube fixed to the enclosure has an open inlet end communicating with the upper space and an open exhaust end outside the enclosure. A secondary air inlet is arranged to direct a stream of air toward the inlet end of the combustion tube, whereby product gas formed by gasification of solid fuel on the grate and passing through the reactor tube into the upper space will be drawn into the combustion tube to create a sub-atmospheric pressure in the upper space.

The combustion device according to the invention is simple and efficient, due in particular to the separate cylindrical reactor tube placed vertically on the partition and open at both ends, enabling an optimum gasification of the fuel in a reactor tube that is spaced from exterior walls of the reactor space. By virtue of the above, outside surface temperatures of the combustion device can be minimized and the efficiency can be significantly improved. Pellets are fed to the grate as needed in response to an optical detector in the top of a pellet feed chute over the reactor tube, and are not piled high over the grate, so that they are not highly heated prior to being fed and do not disintegrate. This represents an important advantage over Ohlsson U.S. Pat. No. 2,354,963.

The invention furthermore has the advantage that the rate of product gas being gasified from the solid fuel will increase, so that higher flame and radiation temperatures in the combustion tube will be achieved. Further, the shape of the burner's flame has a wide cross section and is elongated, so it is useful in many kinds of boilers. Also, very little flue dust is generated, which reduces particulate emission of the burner so that the need for chimney sweeping of the smoke flue also decreases. The combustion process of the combustion device according to the invention is more like an oil burner than traditional pellet burners, whereby it offers a viable alternative when renewing heating systems.

DETAILED DESCRIPTION OF THE PREFERRED EMBODIMENTS

Figure 1:
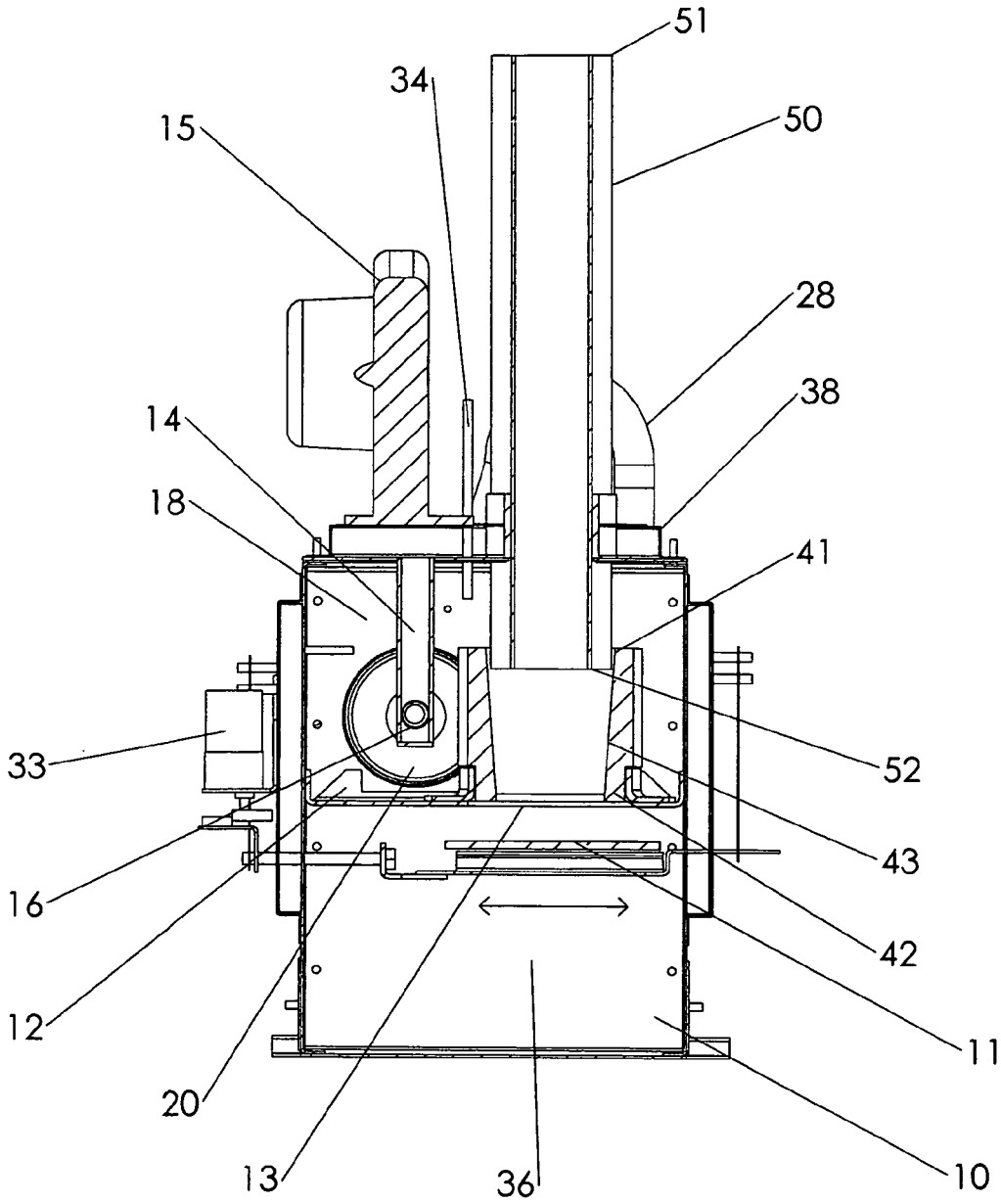
FIG. 1 is a cross-section of the combustion device according to the invention showing the reactor tube and the fuel feed chute.
Figure 3:
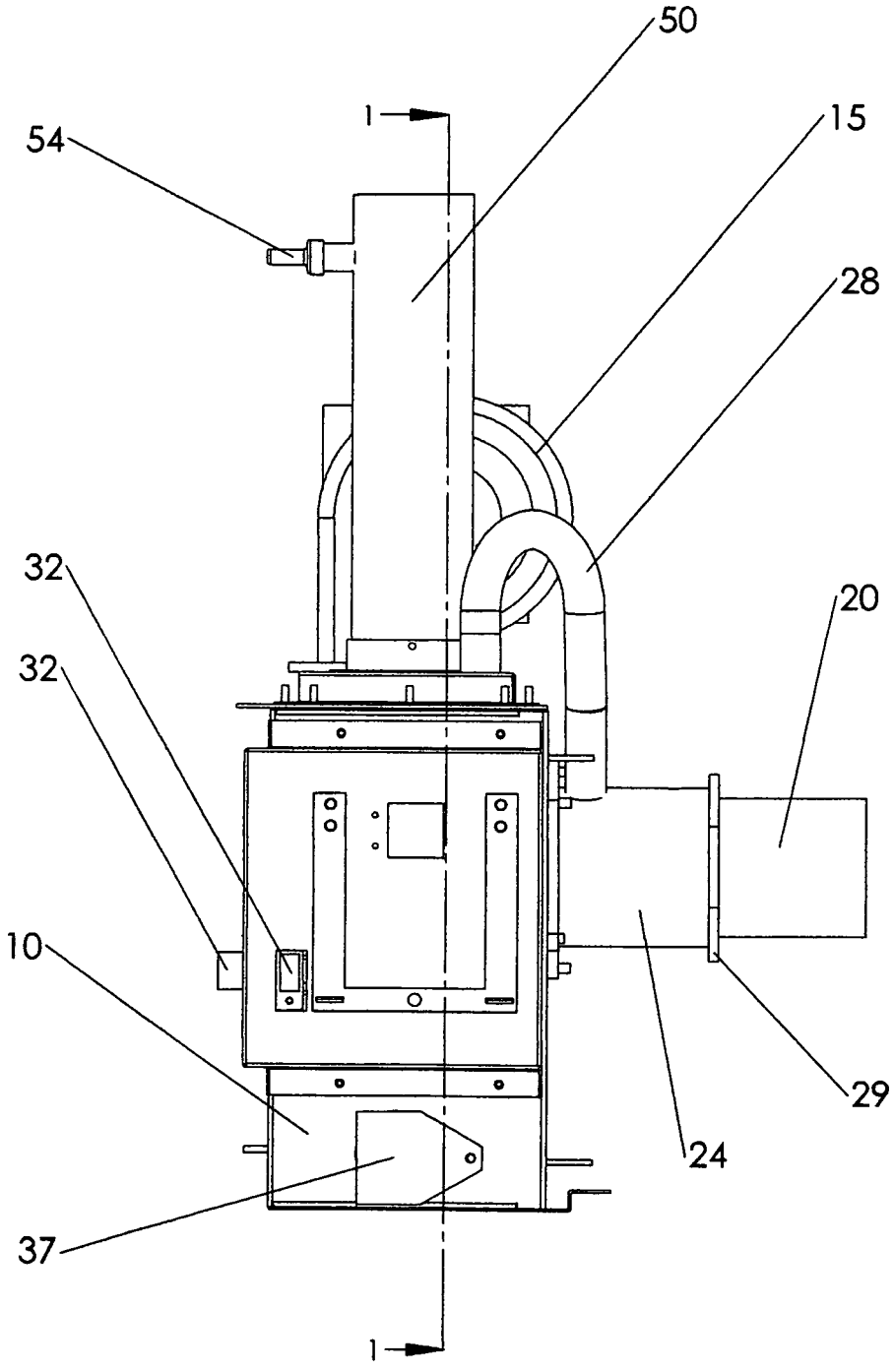
FIG. 3 is a side view of the combustion device.

Referring to FIG. 1, the combustion device includes an enclosure 10 having walls formed of steel sheet and fastened to a frame in known fashion. The walls may be coated on the inside and/or the outside with thermal insulation. A substantially horizontal partition 12 formed of sheet steel, preferably stainless steel plate, divides the enclosure into an upper space 18 and a lower space 19. The partition 12 has a hole 13 which provides essentially the only passage for flow of gas from the lower space to the upper space. A reactor tube 40 having an open upper end 41 in the upper space 18 and an open lower end 42 is supported on the partition 12 concentrically over the hole 13. A grate 11, preferably made of ceramic, is located in the lower space 19 below the hole 13, and is spaced 1.5 to 2.5 cm from the partition 12. A fuel feed chute 50 has an open upper end 51 for connecting to a supply of pellets to form an airtight feed system, and an open lower end 52 that projects into the reactor tube 40 to supply pellets to the grate 11 by gravity. The pellet supply is preferably an auger feed from a silo, but it is also possible to fill the chute manually and close the top with a cover. The fuel is preferably fed periodically, about a pound at a time, in response to feedback from an optical sensor 54 (FIG. 3).

A primary air inlet 30 (FIG. 2) provides air to the grate 11 for gasification of the pellets, which occurs at substantially ambient pressure. The term gasification, as used here, refers to an incomplete combustion that results in flammable product gases that are drawn upward through the pellets piled up in reactor tube 40, as will be described. Heating resistors 32 (FIG. 3) extend into the space between the grate 11 and the partition 12, and are used to ignite the pellets prior to gasification. The reactor tube is preferably made of ceramic, in order to withstand sustained high temperatures. Ash from the gasification of the pellets falls through the grate into an ash space 36 in the bottom of the device. An actuator 33 is linked to the grate to shake it periodically.

The reactor tube 40 has a section with a conical inside surface 43 that converges toward the lower end 42. The pellet feed chute 50 may be moved vertically to vary the gap between the lower end 52 and the conical surface 43, thereby regulating the supply of product gas that can move from the lower space 19 to the upper space 18. In the present case the conical section 43 extends over most of the length of the reactor tube, but variations of this incorporating cylindrical sections are possible. Vertical movement of the chute 50 can be implemented by a rack fixed to its outer surface, and a pinion gear driven by a stepper motor on a frame fixed to the enclosure.

Figure 2:
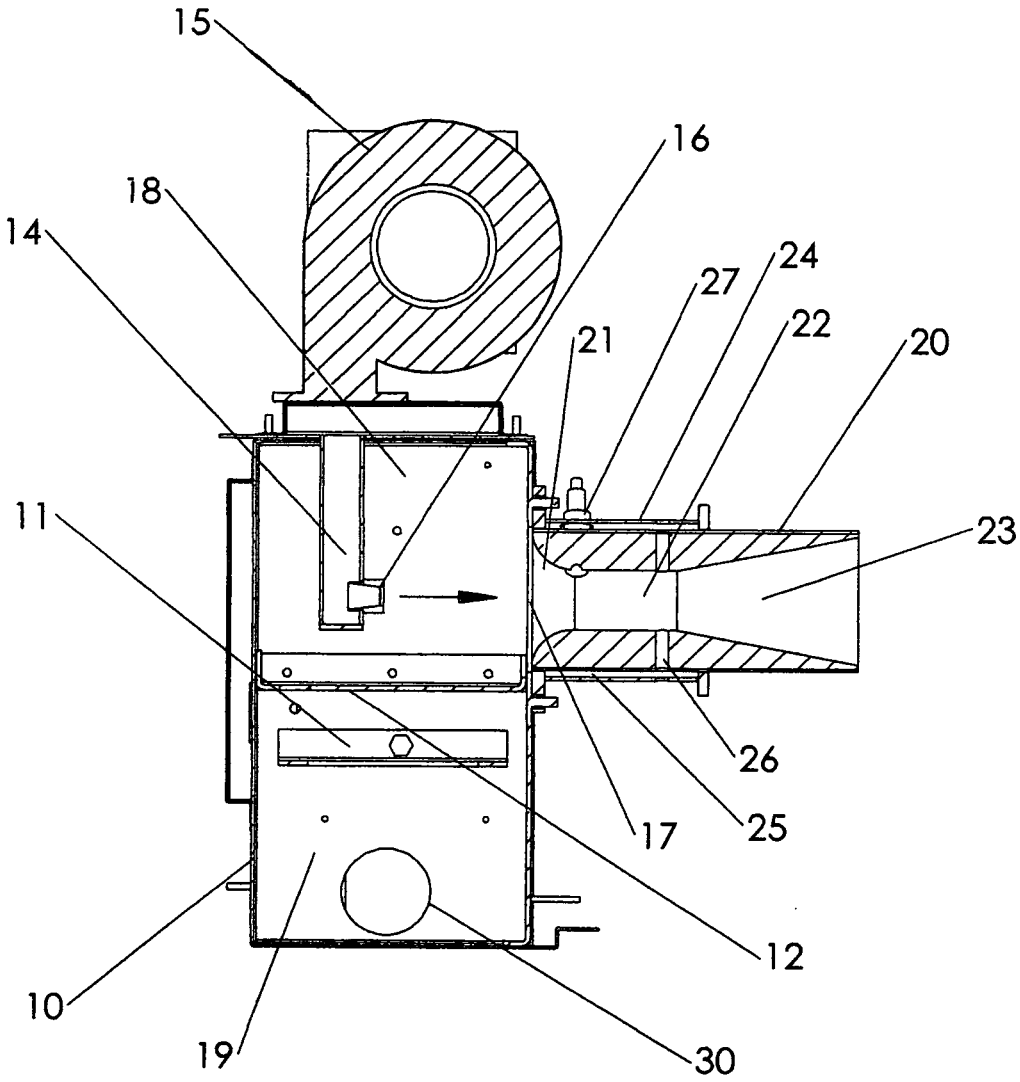
FIG. 2 is a cross-section showing the secondary air inlet and the combustion tube.

Referring also to FIG. 2, a secondary air inlet 14 connected to a variable speed blower 15 provides combustion air which is directed through a nozzle 16 toward a combustion tube 20 fixed against an opening 17 in the enclosure 10. The combustion tube 20 is preferably made of metal and has an inside surface that is preferably coated with ceramic. The inside surface has a rounded entry portion 21, a substantially cylindrical intermediate portion 22 with a cross-sectional area which is smaller than the open inlet end and the open outlet end, and an exhaust portion 23 which diverges conically toward the exhaust end of the tube 20. This corresponds to the shape of a Lempor ejector having an entry, a mixing chamber, and a diffuser. The inside surface may also be smoothly curved like the venturi in a carburetor. Either profile results in a pressure drop according to the Bernoulli principle, which causes product gas to be drawn into the combustion tube by the jet of secondary air from the nozzle 16, resulting in a pressure drop in the upper space 18. This, in turn, causes more product gas to be drawn upward through the reactor tube 40 into the upper space. Note that the flow of secondary air from the nozzle 16 must be substantially laminar in order to achieve a good ejector effect, i.e. to draw product gas into the tube 20 concentrically, rather than mixing with it in the upper space. An ignition spark plug 27 is provided at the transition between portions 21 and 22.

In addition to generating a partial vacuum by the ejector effect, a flue gas extractor (smoke fan) may be provided on the boiler in order to further lower pressure by sucking product gas through the combustion tube 20.

A casing sleeve 24 surrounds the combustion tube 20 and is fixed to it, enclosing an annular space 25 supplied with air under pressure via a tertiary air feed line 28 (FIGS. 4-6) from a plenum 38 communicating with the secondary air inlet 14. The tertiary air is thus preheated as it cools the combustion tube. Preheated tertiary air from the annular space enters the gas flow in the combustion tube 20 via radial passages 26 near the transition between portions 22 and 23, and improves mixing to complete combustion of the product gas, thereby minimizing soot particles, carbon monoxide and nitrogen oxides in the flue gas.

Referring to FIG. 3, the combustion device is shown in an upright position, as it would be fixed to the wall of a boiler. The casing sleeve 24 has an inside flange fixed to the wall of the enclosure 10 and an outside flange 29 for butting against the outside wall of the boiler, so that the exhaust portion 23 of the combustion tube 20 extends into the boiler (not shown). Also visible in this view are the blower 15, which provides combustion air for the secondary air inlet, the secondary air plenum 38, the tertiary air feed 28, and the outer parts of heating resistors 32 for igniting the pellets. An ash hatch 37 is provided so that accumulated ash can be removed from the bottom of the device.

Figure 4:
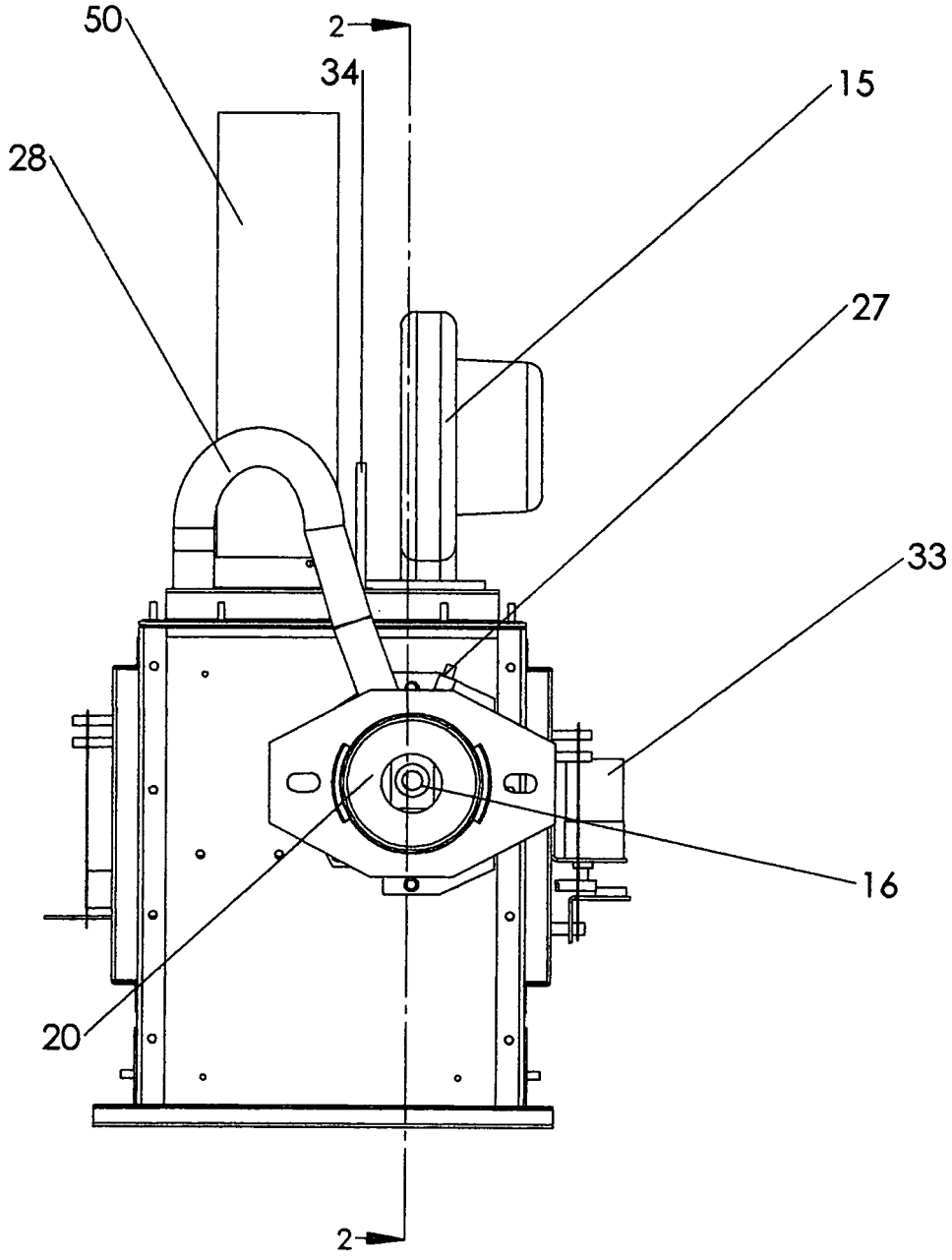
FIG. 4 is another side view, as seen from the right side of FIG. 3.

Referring to FIG. 4, the blower 15, tertiary air feed 28, and combustion tube 20 are again visible. The nozzle 16 for supplying a jet of secondary air toward the combustion tube 20 is also visible through the open end of the combustion tube 20. The grate actuator 33 rotates a cam which causes a rapid linear motion of the grate in order to loosen ash. A temperature sensor 34 on top of the unit detects the temperature inside the enclosure corresponding to the temperature of the product gas after gasification has begun.

Figure 5:
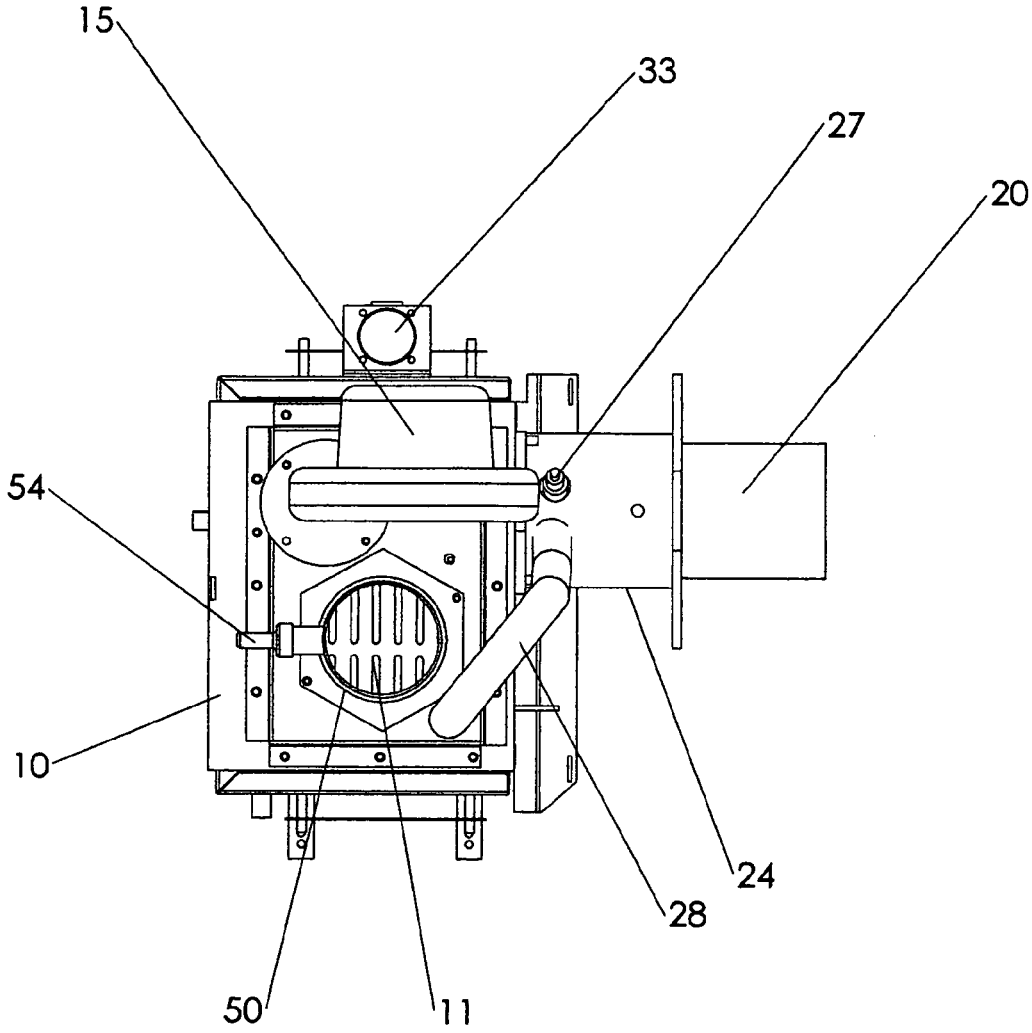
FIG. 5 is a top view of the combustion device.

FIG. 5 is a top view of the combustion device showing many of the aforementioned features. The grate 11 where the pellets are gasified is visible through the feed chute 50.

It is possible to monitor burning of the flame by means of a light sensor placed in the combustion head 20. If the light sensor notices that the burner's flame dies, the flame will be ignited immediately by the spark plug 27. The spark plug and light sensor are known from oil burners, and need not be described in greater detail in this context.

The pellet burner according to the invention has an automatic control system which monitors and controls the combustion process, whereby among other things activating of the fuel feed, operating heating resistors, regulating speed of the secondary air blower, and firing of the spark plug are controlled. The control system has different measuring sensors that collect information about the combustion process. An optical sensor 54 is provided to monitor light from pellets burning on the grate, so that the feed screw from the pellet silo (not shown) can activated. This sensor also acts as a flame monitoring device according to EN-pellet burner standard. In the upper space there is a temperature detector 34, which measures temperature of the product gas from the pellets. A lambda-detector (not shown) can be placed in the heating boiler's exhaust flue for measuring residual oxygen content of the flue gas. Based on information received from these detectors, the control system can adjust the amount of pellets to be fed into the reactor tube 40, the surface height of the pellet bed on the grate 11 in the reactor tube, and the rotational speed of the blower.

There is also an NTC (negative temperature coefficient) sensor which measures boiler water temperature. When this temperature falls below a level set by the user, the device is run on full power until it exceeds that level by a given amount, e.g. 10 degrees, whereupon the unit is run on idle. The ratio of maximum to minimum or idle power is known as the turndown ratio.

The pellet burner shown in FIGS. 1-5 operates in the following manner. When the burner's control system gets information about the need for heat (e.g. when the temperature of circulation water of the heating boiler decreases to a preset minimum level), it ignites the burner automatically. During ignition, pellets get dropped on the grate 11 below the reactor tube 40. During combustion there is an underpressure in the upper space, so that primary air will be drawn into the lower space and pellets will burn by smoldering to form product gas. Where the pellets are wood pellets, the product gas is wood gas, which contains mainly carbon monoxide and hydrogen. The generated product gas is drawn into the combustion tube 20, where it gets ignited by the secondary air flow mixed therewith, or, when needed, by means of a spark electrode. The combustion is monitored by the light sensor and the flame is reignited when needed. The amount of generated product gas and accordingly the heating efficiency of the burner is controlled as desired by regulating the speed of rotation of the combustion air blower and possibly by altering height of the fuel bed in the reactor. Ash generated by combustion of the fuel, will fall off through the grate into the ash space, where it is removed as needed through the ash hatch.

The foregoing is exemplary and not intended to limit the scope of the claims which follow.

What is claimed is:

1. A device for gasification and combustion of solid fuel, the device comprising:

an enclosure formed by walls;

a partition dividing the enclosure into an upper space and a lower space, the partition having a hole which provides essentially the only passage for gas to flow from the lower space to the upper space;

a reactor tube projecting into the upper space and spaced from the walls of the enclosure, thereby enabling optimum gasification of fuel in the reactor tube and minimizing surface temperatures of the device, the reactor tube having an open upper end in the upper space and an open lower end supported by the partition over the hole;

a grate located in the lower space below the hole;

a primary air inlet arrangement for feeding air into the lower space for gasification of solid fuel on the grate;

a combustion tube having an open inlet end communicating with the upper space and an open exhaust end outside the enclosure; and a secondary air inlet arrangement for directing a stream of air toward the inlet end of the combustion tube, whereby product gas formed by gasification of solid fuel on the grate and passing through the reactor tube into the upper space will be drawn into the combustion tube to create a sub-atmospheric pressure in the upper space.

2. The device of claim 1 wherein the secondary air inlet arrangement comprises a nozzle for directing a laminar stream of air toward the inlet end of the combustion tube.

3. The device of claim 1 wherein the combustion tube has an intermediate section with a cross sectional area which is reduced with respect to said open inlet end and said open exhaust end.

4. The device of claim 3 wherein the combustion tube is profiled as a venturi tube.

5. The device of claim 1 further comprising a blower for providing air to the secondary air inlet arrangement under pressure.

6. The device of claim 1 wherein the reactor tube is made of ceramic material.

7. The device of claim 1 wherein the reactor tube has a section with an internal profile which converges conically toward the lower end.

8. The device of claim 1 further comprising a fuel feed chute arranged to let solid fuel flow onto the grate by gravity, the chute having an upper end which can be closed airtight, and a lower end which penetrates the reactor tube.

9. The device of claim 8 wherein the fuel feed chute is movable vertically with respect to the enclosure, whereby the lower end of the feed chute penetrates the reactor tube a variable distance.

10. The device of claim 9 wherein the reactor tube has a section with an internal profile which converges conically toward the lower end of the reactor tube, the lower end of the feed chute extending into said section, whereby the distance between the lower end of the feed chute and the section of the reactor tube can be varied by moving the feed chute vertically.

11. The device of claim 1 further comprising a tertiary air inlet arrangement for feeding air into the combustion tube between the inlet end and the exhaust end, the tertiary air inlet arrangement comprising a casing surrounding the combustion tube to form an annular space, and flow channels extending between the annular space and an inside surface of the combustion tube.

12. The device of claim 11 wherein the tertiary air inlet arrangement comprises an air feed branch from the secondary air inlet arrangement.

13. The device of claim 11 wherein the tertiary air inlet arrangement comprises an air feed branch from the secondary air inlet arrangement.

14. A device for gasification and combustion of solid fuel, the device comprising:

an enclosure formed by walls;

a partition dividing the enclosure into an upper space and a lower space, the partition having a hole which provides essentially the only passage for gas to flow from the lower space to the upper space;

a reactor tube having an open upper end in the upper space and an open lower end supported by the partition over the hole;

a grate located in the lower space below the hole;

a primary air inlet arrangement for feeding air into the lower space for gasification of solid fuel on the grate;

a combustion tube having an open inlet end communicating with the upper space and an open exhaust end outside the enclosure; and a secondary air inlet arrangement comprising a nozzle for directing a laminar stream of air toward the inlet end of the combustion tube, whereby product gas formed by gasification of solid fuel on the grate and passing through the reactor tube into the upper space will be drawn into the combustion tube to create a sub-atmospheric pressure in the upper space.

15. The device of claim 14 wherein the combustion tube has an intermediate section with a cross sectional area which is reduced with respect to said open inlet end and said open exhaust end.

16. The device of claim 15 wherein the combustion tube is profiled as a venturi tube.

17. The device of claim 14 further comprising a blower for providing air to the secondary air inlet arrangement under pressure.

18. The device of claim 14 further comprising a tertiary air inlet arrangement for feeding air into the combustion tube between the inlet end and the exhaust end, the tertiary air inlet arrangement comprising a casing surrounding the combustion tube to form an annular space, and flow channels extending between the annular space and an inside surface of the combustion tube.

19. A device for gasification and combustion of solid fuel, the device comprising:

an enclosure formed by walls;

a partition dividing the enclosure into an upper space and a lower space, the partition having a hole which provides essentially the only passage for gas to flow from the lower space to the upper space;

a reactor tube having an open upper end in the upper space and an open lower end supported by the partition over the hole;

a grate located in the lower space below the hole;

a primary air inlet arrangement for feeding air into the lower space for gasification of solid fuel on the grate;

a combustion tube having an open inlet end communicating with the upper space and an open exhaust end outside the enclosure;

a secondary air inlet arrangement for directing a stream of air toward the inlet end of the combustion tube, whereby product gas formed by gasification of solid fuel on the grate and passing through the reactor tube into the upper space will be drawn into the combustion tube to create a sub-atmospheric pressure in the upper space; and a fuel feed chute arranged to let solid fuel flow onto the grate by gravity, the chute having an upper end which can be closed airtight, and a lower end which penetrates the reactor tube, wherein the fuel feed chute is movable vertically with respect to the enclosure, whereby the lower end of the feed chute penetrates the reactor tube a variable distance.

20. The device of claim 18 wherein the reactor tube has a section with an internal profile which converges conically toward the lower end of the reactor tube, the lower end of the feed chute extending into said section, whereby the distance between the lower end of the feed chute and the section of the reactor tube can be varied by moving the feed chute vertically.

* * * * *